US005549415A

United States Patent [19]

Evans

[11] Patent Number: 5,549,415

[45] Date of Patent: Aug. 27, 1996

[54] SEPTIC TANK DRAINFIELD INSTALLATION DEVICE AND METHOD

[75] Inventor: Kelvin T. Evans, Orange City, Fla.

[73] Assignee: Dixie Septic Tank, Inc., Orange City, Fla.

[21] Appl. No.: 464,971

[22] Filed: Jun. 5, 1995

[51] Int. Cl.[6] ..... E02B 11/00

[52] U.S. Cl. ..... 405/43; 405/51

[58] Field of Search ..... 405/36, 43, 44, 405/51, 128

[56] References Cited

U.S. PATENT DOCUMENTS

| | | | |
|---|---|---|---|
| 1,060,870 | 5/1913 | Wiley . | |
| 3,060,693 | 10/1962 | Taylor . | |
| 3,403,519 | 10/1968 | Balko . | |
| 3,441,140 | 4/1969 | Thurber . | |
| 3,446,025 | 5/1969 | Koch | 405/43 |
| 3,451,136 | 6/1969 | Shuttle | 465/36 X |
| 3,568,455 | 3/1971 | McLaughlin et al. . | |
| 3,823,825 | 7/1974 | Bergles et al. | 210/170 |
| 4,019,326 | 4/1977 | Herveling et al. | 210/491 X |
| 4,043,139 | 8/1977 | Scott | 61/105 |
| 4,090,686 | 5/1978 | Yarbrough | 61/105 X |
| 4,126,012 | 11/1978 | Waller | 405/157 |
| 4,268,189 | 5/1981 | Good | 405/154 |
| 4,425,172 | 1/1984 | Schirmer | 405/51 X |
| 4,588,325 | 5/1986 | Seefert | 405/46 |
| 4,681,684 | 7/1987 | Maroschak et al. | 210/532.2 |
| 4,878,781 | 11/1989 | Gregory et al. | 405/36 X |
| 5,015,123 | 5/1991 | Houck et al. | 405/45 |
| 5,226,456 | 7/1993 | Semak | 138/107 |
| 5,242,247 | 9/1993 | Murphy | 405/154 |
| 5,383,314 | 1/1995 | Rothberg | 405/43 X |

OTHER PUBLICATIONS

State of Floride Department of Health and Rehabilitative Services, Chapter 10D-6, Florida Administrative Code, *Standards for Onsite Sewage Treatment and Disposal Systems,* Jan. 1993 (68 pages).

*Primary Examiner*—Roger J. Schoeppel

*Attorney, Agent, or Firm*—Allen, Dyer, Doppelt, Franjola & Milbrath, P.A.

[57] ABSTRACT

A drainfield pipe support device includes a pair of elongated anchor members generally parallel to each other and separated for receiving drainfield pipe sections therebetween. The elongated anchor members penetrate a grade surface for holding the anchor members upright while supporting the pipe section within a clamp above the grade surface. The clamp is pivotally attached to the anchor member upper portion and holds a rib extending radially from the pipe section between jaws of the clamp for holding the pipe section from an upper portion of the pipe section. The device and method for installing drainfield pipe sections by supporting such sections from a pipe section top portion permits the sections to be held at desired positions for introduction of aggregate into an absorption area containing the drainfield pipe sections without displacing the sections from their desired location. Further, support devices holding the sections in place can then be removed without displacing the sections once they have been positioned.

20 Claims, 13 Drawing Sheets

SEPTIC TANK DRAINFIELD INSTALLATION DEVICE AND METHOD

BACKGROUND OF INVENTION

1. Field of Invention

The invention relates to a method and device for the installation of on-site sewage treatment and disposal systems and in particular to the installation of a septic tank and drainfield.

2. Background Art

As defined in the Florida Administrative Code, Rule 10D-6, Department of Health and Rehabilitative Services, Standards for Onsite Sewage Treatment and Disposal Systems, onsite sewage treatment and disposal systems comprise a sewage treatment and disposal facility, that contains a standard subsurface, filled or mound drainfield system, an aerobic treatment unit, a grey water system tank, a laundry wastewater system tank, a septic tank, a grease interceptor, a dosing tank, a solids or effluent pump, waterless, incinerating or organic waste composting toilets, or a sanitary pit privy that is installed beyond a building sewer on land of the owner or on other land to which the owner has the legal right to install a system. As further defined in the above referenced Code, a drainfield comprises a system of open jointed or perforated piping, approved alternative distribution units, or other treatment facilities designed to distribute effluent for filtration, oxidation and absorption by the soil within the zone of aeration. Further defined in the Code, is a septic tank, which is a watertight receptacle constructed to promote separation of solid and liquid components of wastewater, to provide limited digestion of organic matter, to store solids, and to allow clarified liquid to discharge for further treatment and disposal into the drainfield.

Typically, drainfields are "standard subsurface systems", "filled systems", or "mound systems." The above referenced Code defines a standard subsurface drainfield system as an onsite sewage treatment and disposal system drainfield consisting of a distribution box or header pipe and a drain trench or absorption bed with all portions of the drainfield sidewalls installed below the elevation of undisturbed native soil. A filled system is defined as a drainfield system where a portion, but not all, of the drainfield sidewalls are located at an elevation above the elevation of undisturbed native soil on the site. Mound systems are defined as drainfields constructed at a prescribed elevation in a prepared area of fill material. All drainfields where any part of the bottom surface of the drainfield is located at or above the elevation of undisturbed native soil in the drainfield area is a mound system.

Drain trenches and absorption beds are the standard for drainfield systems used for disposing of effluent from septic tanks or other sewage waste receptacles. An absorption bed comprises an area in which the entire earth content to a specified depth in the required absorption area is removed, replaced with aggregate to that specified depth, and distribution pipe or other approved drainfield components. The distance between the centers of the distribution lines in standard beds is to be a maximum of 36 inches in order to meet the above referenced Code. Further, the distance between the side wall of the bed and the center of the outside drain is to be no more than 18 inches, but shall not be less than six inches. Header pipe is to extend to within 18 inches of the side walls. The maximum depth from the bottom of the drainfield to the finished ground surface shall not exceed 30 inches after natural settling. The minimum earth cover over the top of the drainfield, distribution box or header pipe in standard subsurface drainfields shall be 6 inches after natural settling. By way of example, depending on the type of drainfield system being utilized, the drainfield absorption surface is to be constructed level or with a downward slope not exceeding one inch per 10 feet. Such requirements, although given here for one state, are typical of the stringent requirements for drainfields. When one considers the lightweight, flexible polyethylene pipe typically used in such drainfields, and the aggregate of heavy gravel, it is appreciated that holding to such dimensional code requirements is difficult, time consuming and costly. A typical system might include a four inch minimum inside diameter having two rows of holes having a specified perforated area. The perforations must be located at a particular angle from a vertical on either side of centerline of the bottom of the pipe. Further, the pipe must be installed so that the perforations are effective in the effluent treatment. Twisting of the pipe can cause a hole to be at the very bottom during installation. Such a condition will not meet Code and will not pass an inspection. It is required that the perforations be such that the effluent is distributed as equally as possible throughout the drainfield area. It is not unusual for a standard drainfield installation to take a three man crew with back hoe more that a day to install a typical standard subsurface drainfield to within Code tolerances. It is also well known that many installations have to be reinstalled because an inspector failed the original installation because a grade or separation dimension was not met.

As described in U.S. Pat. No. 5,015,123 to Houck et al., conventional drainage systems of the type described and to which the present invention relates typically comprise horizontally extending corrugated and perforated plastic pipe placed within the drainfield area surrounded by a quantity of loose aggregate material, such as rock or crushed stone. By way of example and in the case of the standard subsurface drainfield, the space between the conduit and the ground occupied by the aggregate defines a drainage cavity in fluid communication with the perforations of the conduit. Such a nitrification field comprises effluent discharging from a septic tank through the perforated pipe of a nitrification line which in surrounded by a specified minimum volume of aggregate material, such as rock or crushed stone. The nitrification field creates a storage area for sewage effluent to be absorbed by the soil. The aggregate maintains the boundaries of the storage area, prevents blockage of the pipe perforations, and promotes the beneficial effects of biomat development wherein aerobic bacteria organisms act on the sewage colloidal materials to reduce them in the soil. The perforated conduit serves the purpose of delivering the effluent to the aggregate filled cavity for absorption into the soil and to vent sewage gases for preventing local contamination. The use of corrugated pipe permits the trapping of effluent for a secondary, a semi-aerobic treatment within the pipe corrugations.

Houck '123 particularly discloses a method and apparatus for the installation of a drainage field. Houck '123 describes a method and apparatus that employs a preassembled drainage line unit for placement in a trench which provides a uniformity and ease of installation. The preassembled drain line comprises loose aggregate in the form of light weight materials in a surrounding relationship to perforated conduit bounded by a sleeve member. As stated by Houck '123, the requirements for uniformity and inspections for compliance with state and local codes makes the drainfield installation process tedious and time consuming. Houck '123 looks away from the teachings of the standards employing typical gravel aggregate to fill a trench or absorption bed.

U.S. Pat. No. 4,268,189 to Good discloses an apparatus and method for supporting and positioning pipe during the construction of drain fields and the like. The apparatus comprises a horizontal elongate support member with spaced apart clamping units thereon arranged for suspending flexible pipe sections from the elongate support member. The elongate support member is adjustably supported for vertical adjustment on substantially vertically disposed elongate anchoring members adapted to be driven into a grade surface so as to firmly anchor the respective pipe supporting apparatus against displacement in order to maintain the same and the pipe sections supported thereby against horizontal or vertical displacement during the pouring and spreading of aggregate around the pipe sections. The arrangement facilitates the subsequent releasing of the pipe sections from the pipe supporting apparatus and the removal of the pipe supporting apparatus from the aggregate while leaving the corresponding pipe sections embedded in the aggregate. As addressed in the Good '189 patent, the proper positioning of flexible pipe during the construction process has met with difficulty, since such pipe must be maintained in a proper position while being surrounded by the aggregate, as herein earlier described. Clamping the flexible pipe from the sides and below, although securing the pipe during aggregate pouring, can cause movement in the pipe when the apparatus is being pulled from the aggregate. Further, the combination of the elongate horizontal support member and fixed clamping members limit flexibility of use in varying length pipe runs and varying absorption bed layouts. Convenience and ease of use is desirable during the construction process.

U.S. Pat. No. 5,242,247 to Murphy discloses a pipe laying apparatus for maintaining the pipe placement during substantial completion of back filling of a trench in which the pipe is being laid. The apparatus comprises a shaft having an adjustable sleeve and an adjustable pipe grasping sleeve adapted for engagement to a variety of sized pipes. The apparatus is securely placed in to the trench by manual manipulation of handles or by striking a strike plate with a hammer. Murphy '247 addresses the need for fast and convenient removal of the apparatus from a trench. The use of multiple pipe-holders provides such convenience. However, the apparatus as disclosed by Murphy '247 comprises a pipe support placed below the pipe for holding the pipe at a fixed level. In operation, after backfilling a trench to a level above the pipe, the apparatus is rotated ninety degrees for lifting out of the trench while the pipe remains in place. With drainfields using flexible corrugated and perforated flexible pipe surrounded by aggregate material typically of stone, gravel and the like, rotating the apparatus becomes difficult and causes the flexible pipe to be displaced proximate the apparatus.

U.S. Pat. No. 3,568,455 to McLaughlin et al. discloses a method of laying pipe in a bed of particle material. A series of posts are removably mounted at spaced positions on the ground along the course of the pipe. The pipe is releasably supported on the posts in a raised condition above the ground while particle material is deposited under the pipe to at least a depth at which the deposit can sustain the pipe in its raised condition. The pipe is released from the support of the posts, and the posts are removed from the deposit while the deposit sustains the condition of the pipe. McLaughlin '455 discloses a bracket plate having an arcuate indentation for mating with the top cylindrical surface portion of various sized pipe. The pipe is held in communication with the arcuate indentation by a flexible cable which wraps around the bottom portion of the pipe while being hingedly attached to one end of the plate and removably connected to an opposing end for securing the pipe in place. Once the trench has been backfilled, the cable is released from the plate opposing end and the device is lifted from the backfilled trench. Although very effective for generally light materials and generally rigid pipe, again, difficulty occurs when using the flexible corrugated pipe and aggregate combination as earlier addressed. The cable wrapped around the pipe dislodges the pipe from its position as the device is pulled from its position.

SUMMARY OF INVENTION

It is an object of the invention to provide a system and method for laying flexible drainfield pipe in an absorption bed or trench backfilled with aggregate such as gravel and stone. It is a primary object of the present invention to provide a method for installing flexible corrugated drainfield pipe having perforations and install such pipe such that it meets code specifications. It is further an object of the invention to provide such a method while minimizing installation time and costs while at the same time maximizing convenience and ease of the construction of such a drainfield. Another object of the invention is to enhance the ease of placement of the drainfield pipe and secure or maintain the placement to within specified code requirements during the backfilling operation. It is yet another object of the invention to provide for the easy removal of the pipe laying devices after the aggregate is in place and remove the devices without displacing portions of the pipe. It is yet another object of the invention to provide a method for securing the pipe at a specified grade while clamping the pipe from a top portion thereof, thereby minimizing pipe displacement caused by portions of the device displacing aggregate proximate the pipe or contacting portions of the pipe during removal and thereby displacing the pipe. It is yet another object of the invention to provide a flexible pipe that can be used in combination with the pipe laying device whereby the combination provides an inexpensive, time saving installation method for a septic tank and drainfield comprising perforated corrugated pipe and stone or gravel styled aggregate. It is further an object of the invention to provide a device and method which facilitates the placement of the pipe within an absorption bed or trench at the specified grade for interconnected flexible pipe sections sufficient to meet the requirements of the drainfield such that a plurality of devices can be conveniently used to set the position and grade of the pipe. It is another object of the invention to support corrugated pipe having perforations positioned for secondary treatment within the pipe in an orientation wherein effluent is permitted to be held within a lower portion of the pipe and nor drain through the perforations as a result of pipe twisted during installation. It is further an object of the invention to provide such a method and device at a low cost and manpower demand as is typical for the art. It is yet another object of the invention to provide an effective method of drainfield pipe inspection pipe surrounded by aggregate.

To that end, the present invention provides a method for installing an on-site sewage treatment drainfield comprising the steps of positioning a first set of pipe supporting devices wherein each device includes means for removably clamping a portion of the device to a pipe upper portion for holding the pipe in suspended relation above an absorption area grade surface. The absorption area is to be filled with an aggregate such as stone or gravel. Each device further has anchoring means for anchoring each devices to the grade surface in a desired alignment for positioning pipe generally horizontally across the absorption area. A first pipe section is provided wherein each pipe section has perforations spaced longitudinally along the pipe section, the perforations spaced along a periphery of the pipe section. The pipe section further has a radially extending member extending from an upper portion therefrom. The upper portion opposes the effluent holding portion. The member is dimensioned to be received by the clamping means. Each device is clamped to the pipe member for supporting the first pipe section using a plurality of the pipe supporting devices. The devices are positioned in spaced relation to each other. The pipe section is held at upper pipe portions displaced along the pipe section wherein the upper portion lies within an upper semicircular pipe portion when viewed in cross-section. The supporting devices are adjusted for positioning the first pipe at a desired height above the grade surface. A second set of pipe supporting devices is positioned adjacent the first pipe. The positioning of the second device set is substantially the same as the positioning for the first device set. The first and second pipe sections are then interconnected. Clamping of the second pipe member is performed for supporting the second pipe section by the second set of pipe supporting devices in substantially the same manner as the first pipe section was supported. Additional pipe sections are positioned for interconnecting with adjacent pipe sections for forming a drainfield system having pipe sections in fluid communication with each other. Aggregate is the poured around the pipe sections to a desired level above the surface grade for providing an absorption bed in fluid communication with the drainfield pipe sections. The devices maintain the pipe sections at a desired horizontal and vertical position within the absorption area. Once the aggregate is at the desired level above the surface grade and is holding the pipe sections in their desired position, the pipe members are released from the clamping means thereby placing each pipe section out of communication with the devices. The devices are then removed from their position by pulling each device generally upward out of anchoring engagement with the grade surface which results in a drainfield positioned to a specific dimension and in fluid communication with an absorption bed of aggregate surrounding the pipe system of the drainfield.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
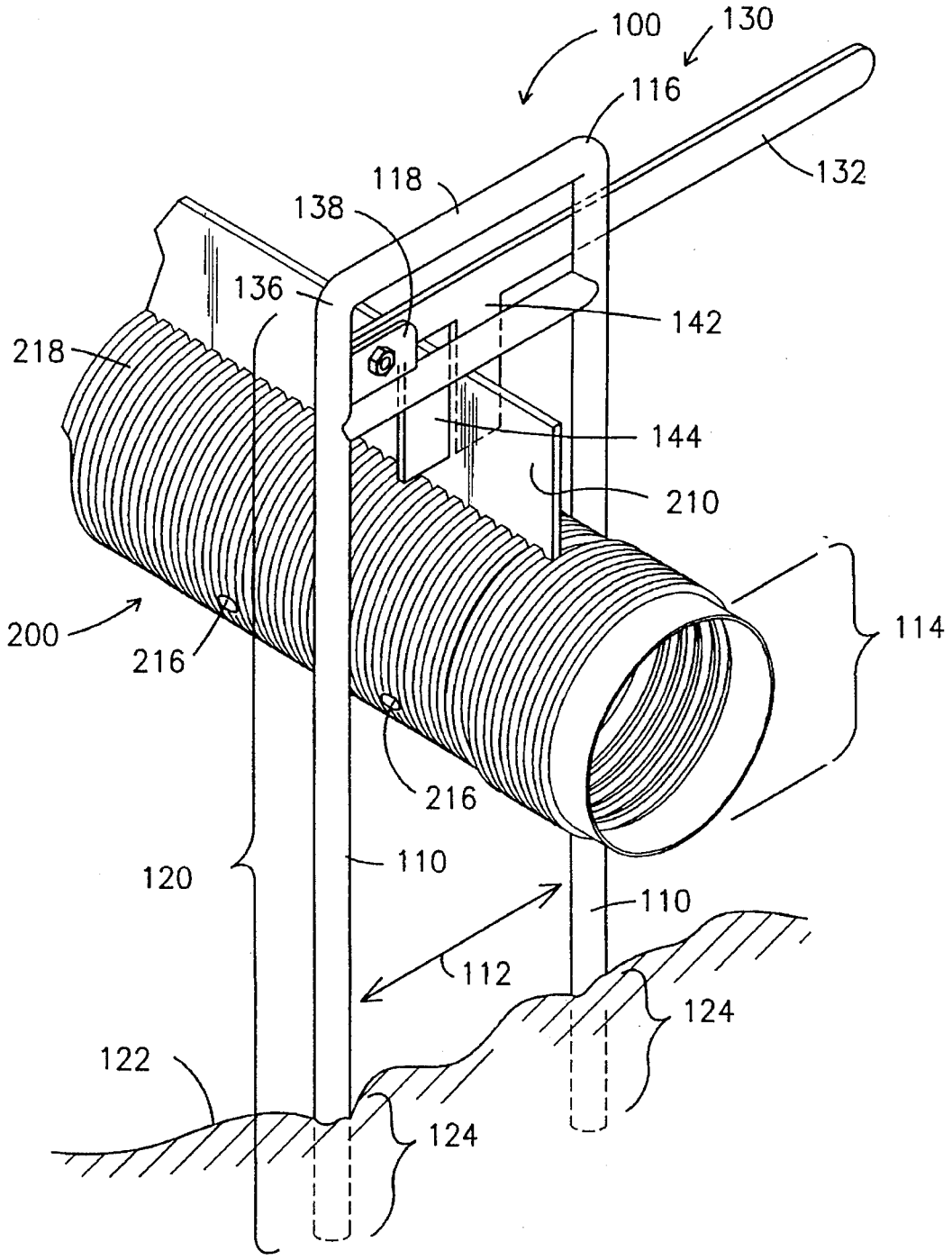
FIG. 1 is a partial left front perspective view of a preferred embodiment of the present invention.
Figure 1A:
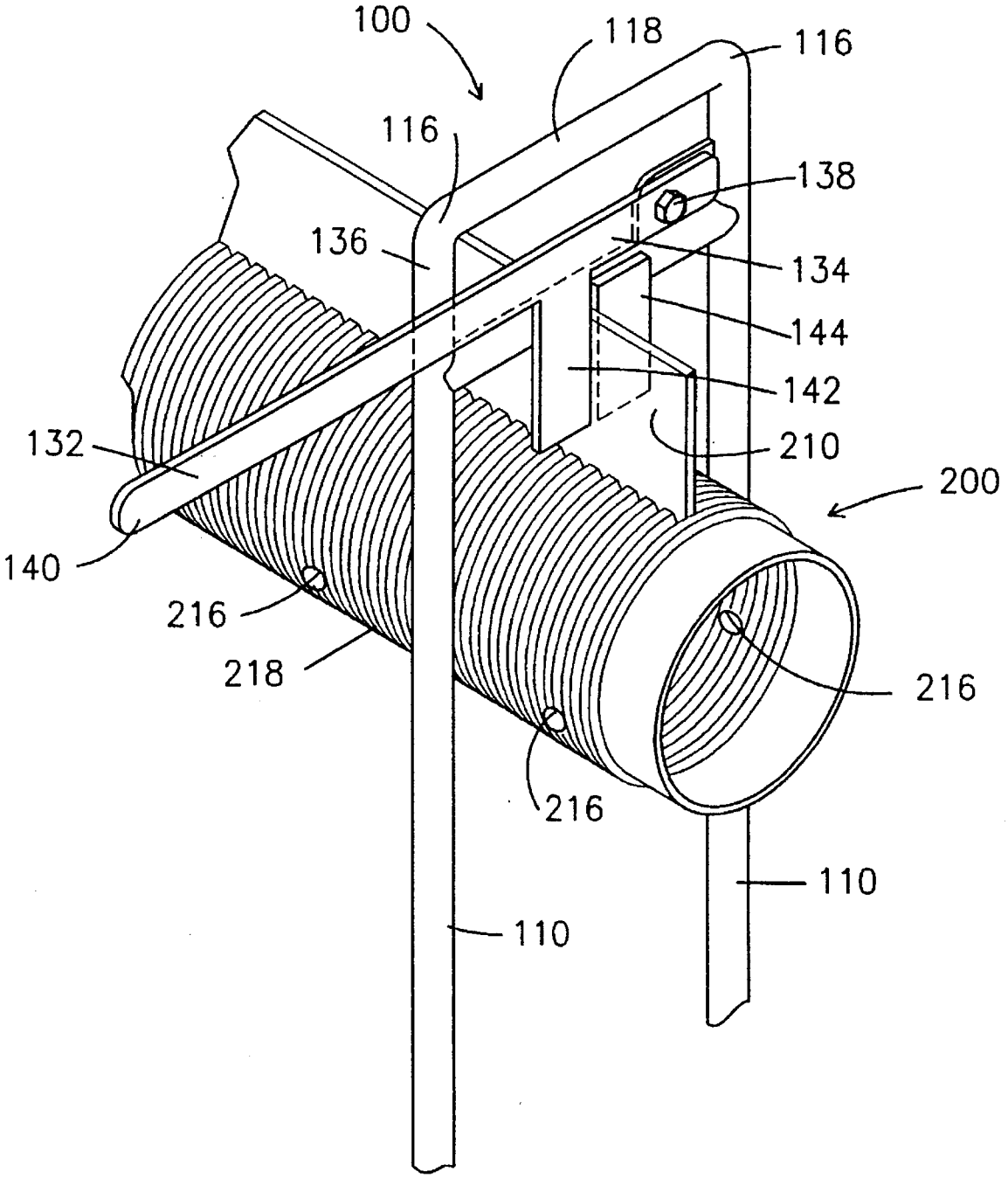
FIG. 1A is a partial right rear perspective view of the pipe supporting device of FIG. 1.
Figure 2:
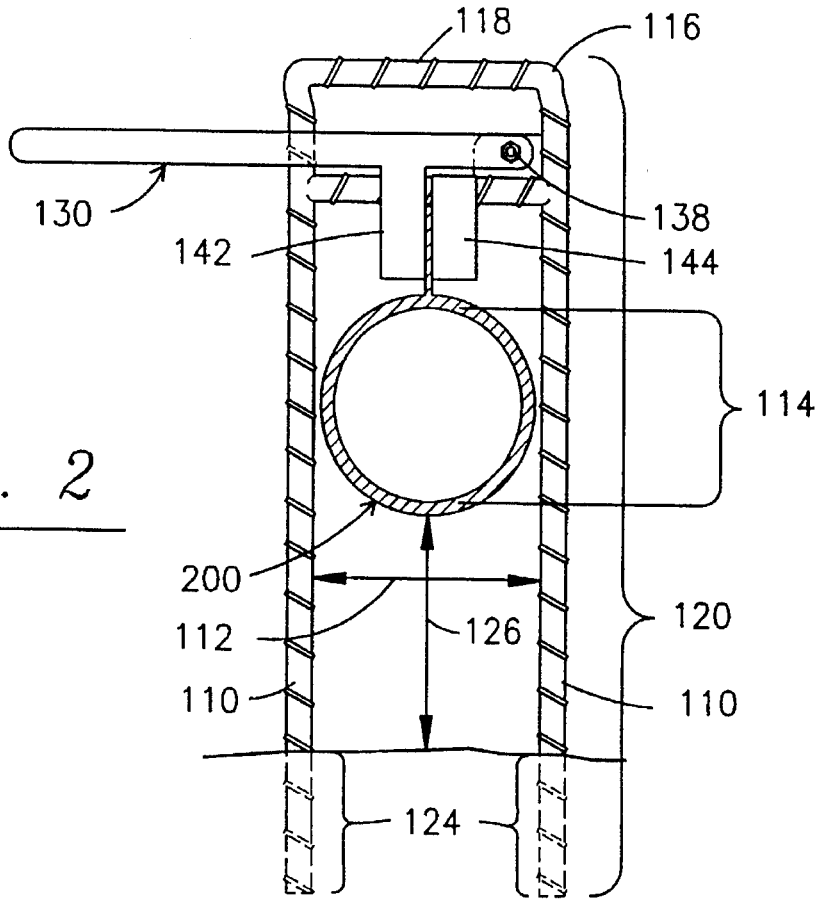
FIG. 2 is a front elevation view of the embodiment of FIG. 1.
Figure 2A:
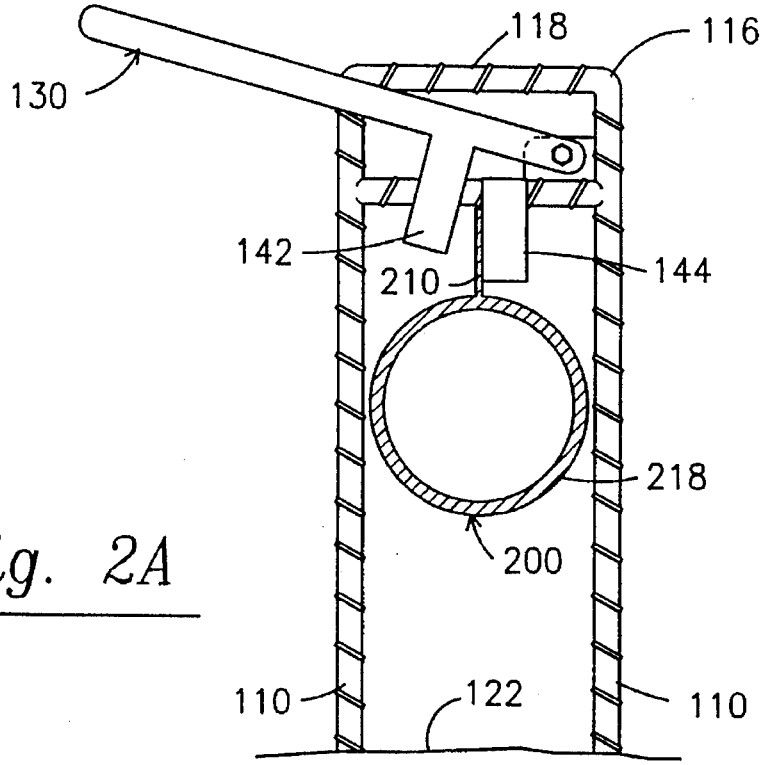
FIG. 2A is a front elevation view of the embodiment of FIG. 2, illustrating a clamp in an open position.
Figure 3:
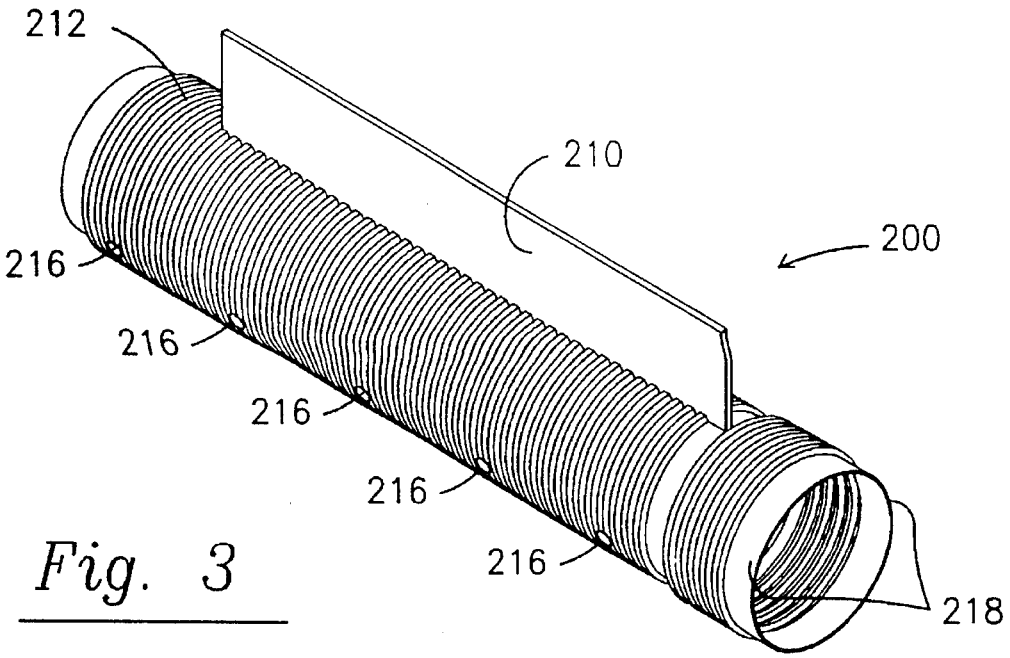
FIG. 3 is a perspective view of a drainfield pipe section of the present invention.

A preferred embodiment of the present invention comprises a pipe supporting device 100 used in combination with a drainfield pipe section 200 as illustrated with reference to FIGS. 1 through 4. In the preferred embodiment of the present invention, the supporting device 100, as illustrated with reference to FIGS. 1 and 2, comprise a pair of elongated anchor members 110 generally parallel to each other and separated by a dimension 112 sufficient for receiving the pipe section 200 therebetween. Although it is anticipated that alternate uses of the present invention will be employed, the preferred embodiment is herein described with reference to a corrugated pipe section having an inside diameter 114 of approximately four inches and an outside diameter including corrugations of approximately four and three quarter inches. In the preferred embodiment, the pipe section 200 loosely fits between the parallel anchor members 110. Again, in the preferred embodiment of the present invention, the anchor members 112 are constructed from readily available "rebar," or steel reinforcing bar stock material well known in the construction industry, which rebar is bent at two locations 116 to form the separation dimension 112 and a device handle portion 118 therebetween again as illustrated with reference to FIG. 1. Any similar bar stock or extrusion that can support the pipe being handled can be used. The length 120 of the elongated anchor members 110 must be sufficient to penetrate a grade surface 122 to a depth 124 sufficient to hold the anchor members 110 upright without other support means while extending the pipe section 200 above the grade surface 122 by a desired height 126. As illustrated with reference to FIG. 3, the pipe section 200 comprises a rib 210 that extends radially outward from a center axis of the pipe section 200. In the preferred embodiment of the present invention, the rib 210 is integrally formed with the pipe section or can be welded along a pipe section top portion 212. The rib 210 must be sufficiently dimensioned to stiffen the pipe section 200 for minimizing flexibility of the pipe section 200 within a plane passing through the pipe section longitudinal axis and including the rib 210. In the preferred embodiment, a rib 210 made from comparable pipe plastic material and having a thickness of approximately one eighth inch is sufficient to limit flexibility within the plane and permit the supporting devices 100 placed along the pipe section length to hold the pipe section 200 to within a desired elevation and grade or slope. As illustrated with reference to FIG. 4, the rib 210 opposes a pipe section bottom portion 214 which holds effluent within the bottom portion 214 during the operation of the drainfield. The bottom portion 214 is further defined by holes 216 located along pipe section side portions 218.

Figure 4:
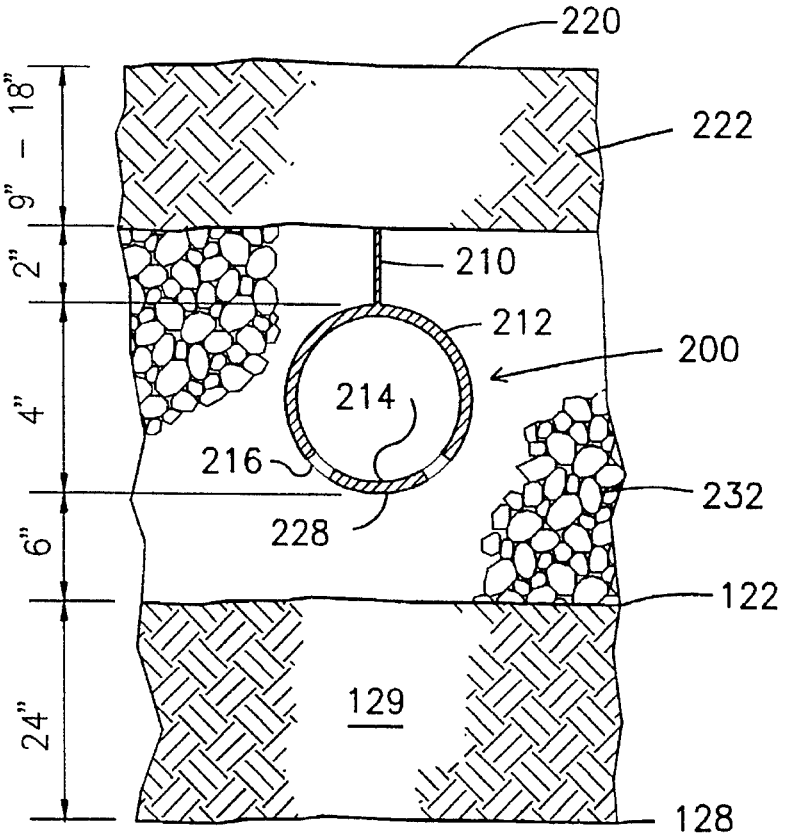
FIG. 4 is a cross-section elevation view of the drainfield pipe of FIG. 3 illustrating its position within an absorption bed.
Figure 5:
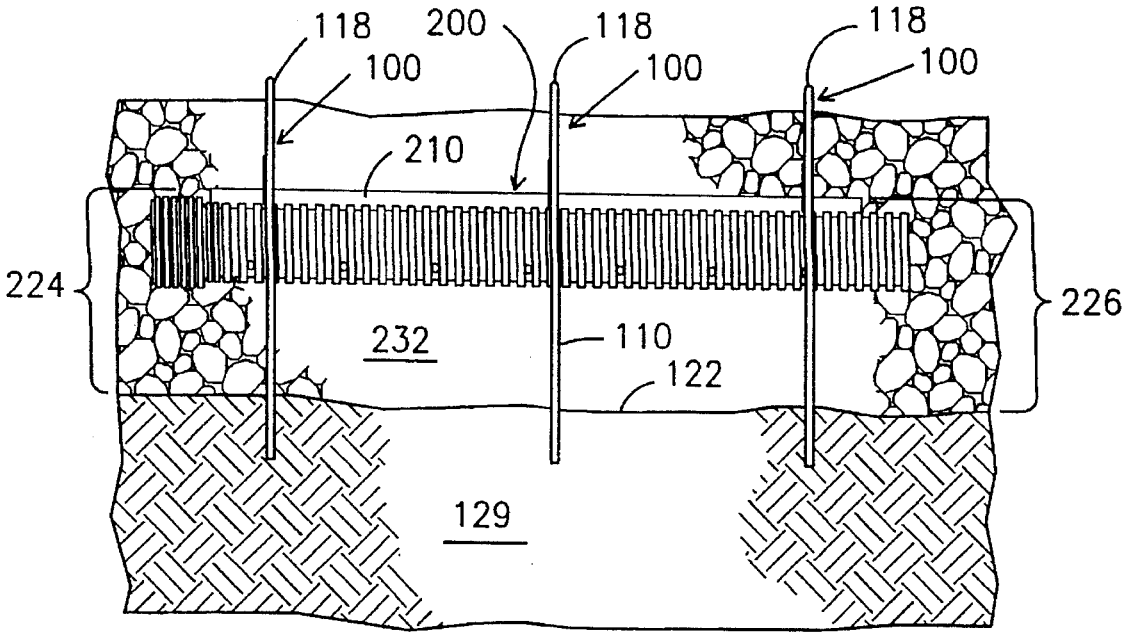
FIG. 5 is a side elevation view of the embodiment of FIGS. 1 and 2 illustrating use of a set of supporting devices for positioning the pipe section of FIG. 3.

As earlier described in the background section of this specification, and given here by way of example, the maximum depth from the bottom of the drainfield, the grade surface 122 as herein described, to the finished ground surface 220, as described with reference to FIG. 4, shall not exceed 30 inches after natural settling. The minimum earth cover dimension 222 over the top of the drainfield, distribution box or header pipe in standard subsurface drainfields shall be 6 inches after natural settling. By way of example, depending on the type of drainfield system being utilized, the drainfield absorption surface is to be constructed level or with a downward slope not exceeding one inch per 10 feet. In other words, the elevation above grade from a first pipe section end 224 to a second pipe section end 226 must not exceed one inch for every foot along the pipe section 200 as illustrated with reference to FIG. 5. Again with reference to FIG. 4, an effective drainfield for a typical Central Florida absorption bed styled installation has the grade surface 122 approximately twenty four inches above natural wet soil 128 for forming a dry soil layer 129. A pipe section bottom most surface 228 is positioned at six inches above the grade surface 122. With a four inch diameter pipe section 200, the top most surface 230 of the pipe section 200 not including the rib 210, will be ten inches above the grade surface 122. With a rib 210 having a two inch height dimension 211, aggregate 232 is filled to the top end 214 of the rib for providing twelve inches of aggregate within the absorption bed area. If a soil cap 234 of approximately nine to twelve inches in placed over the aggregate top surface 236, an effective drainfield is constructed within the code specifications. Further, a two inch rib 210

Figure 6:
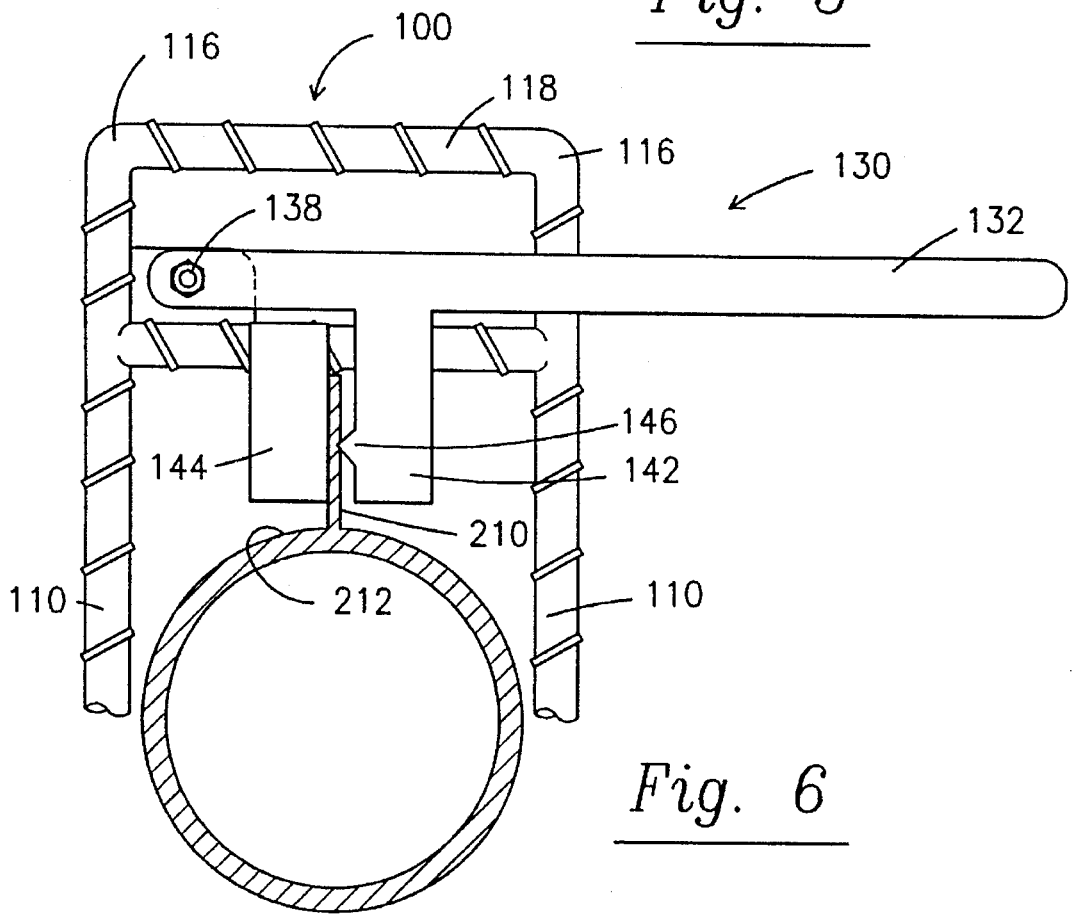
FIG. 6 is a partial front elevation view of a clamp portion of the embodiment of FIGS. 1 and 2.

To accomplish such a configuration as herein described by way of example, the device 100 must hold the pipe section 200 at the desired elevation above the grade surface 122. Again with reference to FIGS. 1 and 2, the device 100 further comprises a clamp 130 having a clamp handle 132 pivotally attached at a distal end 134 to an anchor member upper portion 136 using a pivot pin 138. A handle proximal end 140 permits the handle to be held for movement about the pivot pin 138. In the preferred embodiment of the present invention, a first jaw member 142 is affixed to the clamp handle 132 proximate the handle distal end 134. A second jaw member 144 is affixed to the anchor member upper portion 136 for communicating with the first jaw member 142 in holding the rib 210 between the jaw members 142, 144 as illustrated with reference to FIGS. 1 and 2. As illustrated with reference to FIG. 6, an alternate embodiment of the clamp 130 comprises a pin 146 extending from the first jaw 142 for penetrating a rib side wall surface 238 for enhancing a frictional force between the jaws 142, 144 while holding the rib 210 therebetween and thus the pipe section 200 in the desired position above the grade surface 122. Further, and again with reference to FIG. 5, multiple devices 100 are used longitudinally along the pipe section 200 to support the full pipe section 200 or interconnected sections as will later be described.

Figure 7:
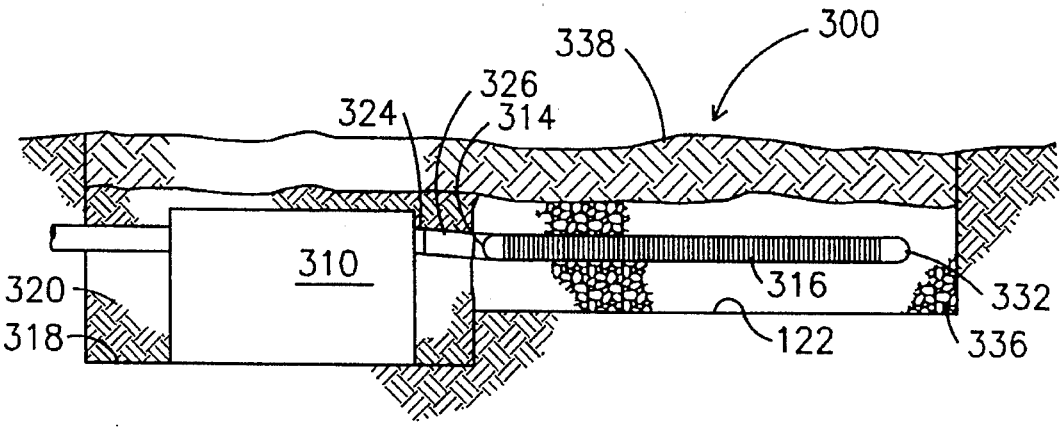
FIG. 7 is a partial side elevation view of an on-site sewer treatment system illustrating a relationship between a septic tank and drainfield.
Figure 8:
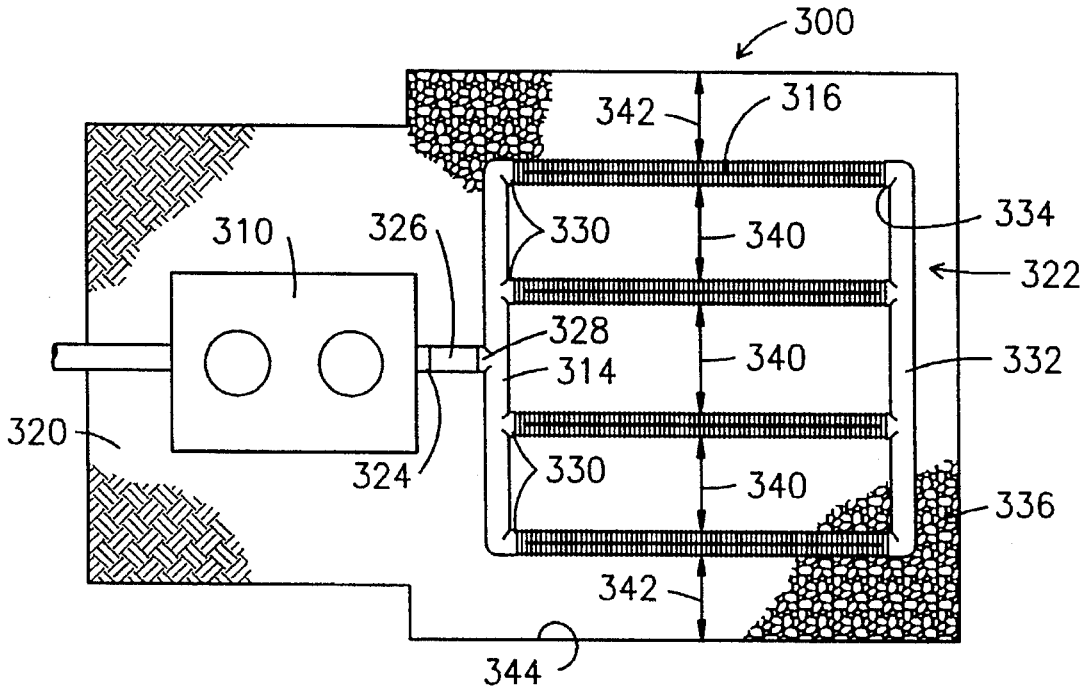
FIG. 8 is a partial top plan view of the sewer treatment system of FIG. 7.

By way of example, a method for installing an on-site sewage treatment system 300 comprising a septic tank 310 and drainfield 312 efficiently and effectively to within code specifications is described with reference to FIGS. 7 and 8 for a well known subsurface drainfield system comprising a header 314 pipe used for distributing effluent into the corrugated pipe sections 316 making up the drainfield 312. In the preferred installation method using the drainfield pipe sections 200 and supporting devices 100 earlier described, the septic tank 310 is positioned at a tank bed surface 318 within a pit 320 dug for placement of the tank 310. A drainfield absorption area 322 is dug wherein the drainfield bed grade surface 122 is at an elevation sufficient for providing a drainfield 316 at an elevation including aggregate 232 around the drainfield 316. The septic tank 310 is positioned for permitting effluent to flow into the drainfield 316 which is in fluid communication with the tank 310. Effluent from the tank 310 passes through a tank outlet port 324 through interconnect pipe 326 to the header pipe section 314 as illustrated again with reference to FIGS. 7 and 8. Typical header pipe sections 314 comprise an inlet junction 328 for connection to the interconnect pipe section 326 and multiple outlet junctions 330 for connection with the drainfield pipe sections 200. The method comprises the step of positioning a first set of pipe supporting devices 100 longitudinally along the header pipe section 314 and supporting the header pipe section 314 at a desired elevation and position within the absorption area 322. In the example of FIG. 7, the header pipe section 314 is positioned below the tank outlet port 324 for gravity feeding of effluent from the tank 310 into the header pipe section 314. The header pipe section 314 is supported by placing devices longitudinally along the header pipe section 314 approximately every two to three feet in the same way as earlier described with reference to the drainfield pipe sections 200. In the preferred embodiment, the header pipe section 314 comprises a rib 210 as earlier described but does not include holes 216 as does the drain field pipe sections 200. The support devices 100 are vertical adjusted by pushing each device 100 into the grade surface 122 or pulling upward from the surface 122 until the desired level for that corresponding portion of header pipe section 314 is at a desired grade or elevation. A method well known for determining elevation uses a laser beam radiating at a given elevation above ground level with drainfield element elevations measured from that beam elevation. It is anticipated that various well known elevation measuring methods will be used during the installation process. Once the header pipe section 314 is at the desired elevation, it is placed in fluid communication with the interconnect pipe 326.

Figure 9:
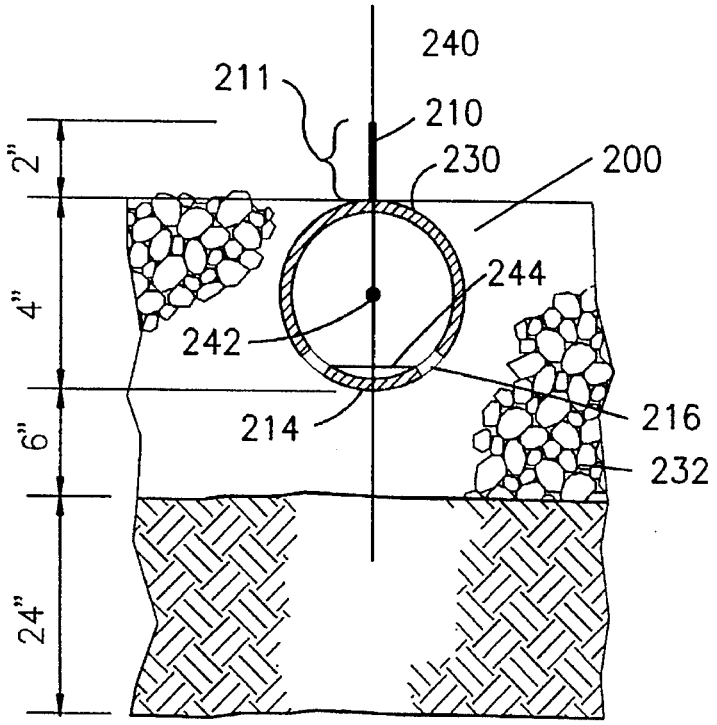
FIG. 9 is a partial cross-section view of a pipe section of the present invention positioned within a partially filled absorption bed.

Pipe sections 316 comprising the pipe sections 200 earlier described are connected at one end to the header pipe section outlet junctions 330. As earlier described with reference to FIG. 4, the rib 210 opposes the pipe section bottom portion 214. With the device 100 supporting the pipe section 200 such that a generally vertical plane 240 includes the rib 210 and a pipe section axis 242 (the rib 210 extends radially outward from the axis 242), it is guaranteed that effluent 244 will be collected within the pipe section bottom portion 214 as earlier defined to be below the holes 216. It is here that secondary treatment of the effluent 244 takes place as illustrated with reference to FIG. 9. Additional sets of pipe section 200 are supported by the devices 100 in a similar manner. In addition, and by way of example, a second header pipe section 332 is connected to ends 334 of drainfield pipe sections 200 as illustrated again with reference to FIG. 8. The second header pipe section 332 is similar to the header pipe section 314 with the exception that no inlet junction 328 is needed for the example given herein. A second header inlet junction is either eliminated from the header or blocked off for the example given with reference to FIGS. 7 and 8. With such an arrangement as described with reference to FIGS. 7 and 8, the tank 310, the interconnect pipe section 326, header pipe section 314, pipe sections 316, and second header pipe section 332 are in fluid communication with each other. With ribs 210 made a part of each pipe section used in the treatment system 300, the devices 100 will support these sections from top portions of the pipe sections.

The pipe sections 314, 316, and 332 are each clamped to devices 100 placed in spaced relation along the sections, generally every two to three feet for the example herein described. Each device 100 is anchored into the bed grade surface 122. In one approach, the devices 100 are placed by estimating their desired location and a more precise alignment and elevation is determined using well known leveling methods as a follow-up procedure. It is anticipated that each operator of the devices 100 and pipe sections 200 will develop alternate techniques understood to be a part of the inventive method and structures herein described.

Aggregate 336 is then distributed into the absorption bed area 322 as illustrated again with reference to FIGS. 7 and 8. With rigidity added to vertical movement of the pipe sections 314, 316, and 332 by the rib 210 sufficient to maintain the sections at the desired elevation when supported by the devices 100, aggregate 336 can be poured uniformly throughout the bed area 322 to a height just covering the rib 210. In this way, the clamp handle 132 is held and pivoted for opening the jaws 144, 146 and thus releasing the frictional hold of the rib 210. With a loose pivot pin 138, the weight of the handle proximal end 140 as a moment arm. Alternately, with a tightened, frictional holding pivot pin 138, the rib 210 is also sufficiently held with biasing of the jaws 142, 144. The devices 100 are then pulled out of their position and removed for covering of the aggregate 336 by appropriate cover material 338 as illustrated again with reference to FIGS. 7 and 8 and as earlier described with reference to FIG. 4.

Again with reference to FIG. 9, an alternate procedure includes filling aggregate 232, typically gravel or crushed concrete and stone material, to the top most pipe section surface 210 while keeping the rib 210 exposed for inspection after the devices 100 have been removed. The rib 210 provides an excellent visual indication of drainfield alignment and it has been experienced that examining authority inspectors gain confidence that a drainfield is properly installed resulting in efficiency in the approval process as well as the installation process. Aggregate 232 can then be poured to cover the rib 210 or earth cover 222 described earlier with reference to FIG. 4, can be poured directly thereon.

Figure 10:
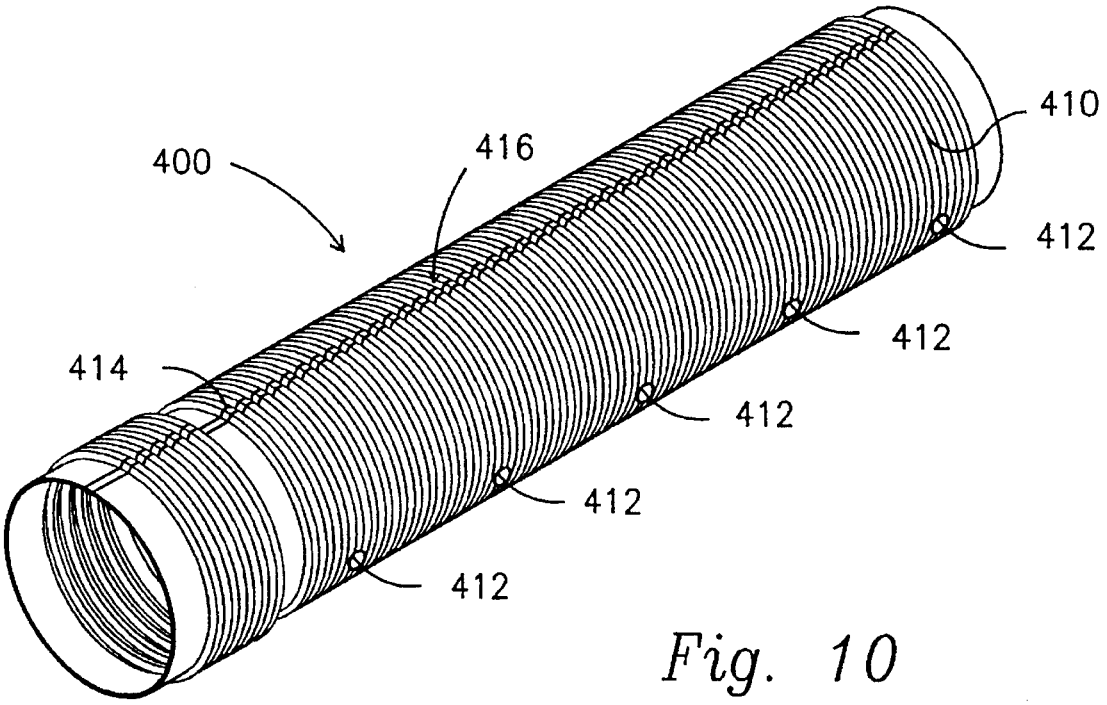
Fig. 10 PRIOR ART
FIG. 10 is a perspective view of a drainfield corrugated pipe well known in the art.
Figure 11:
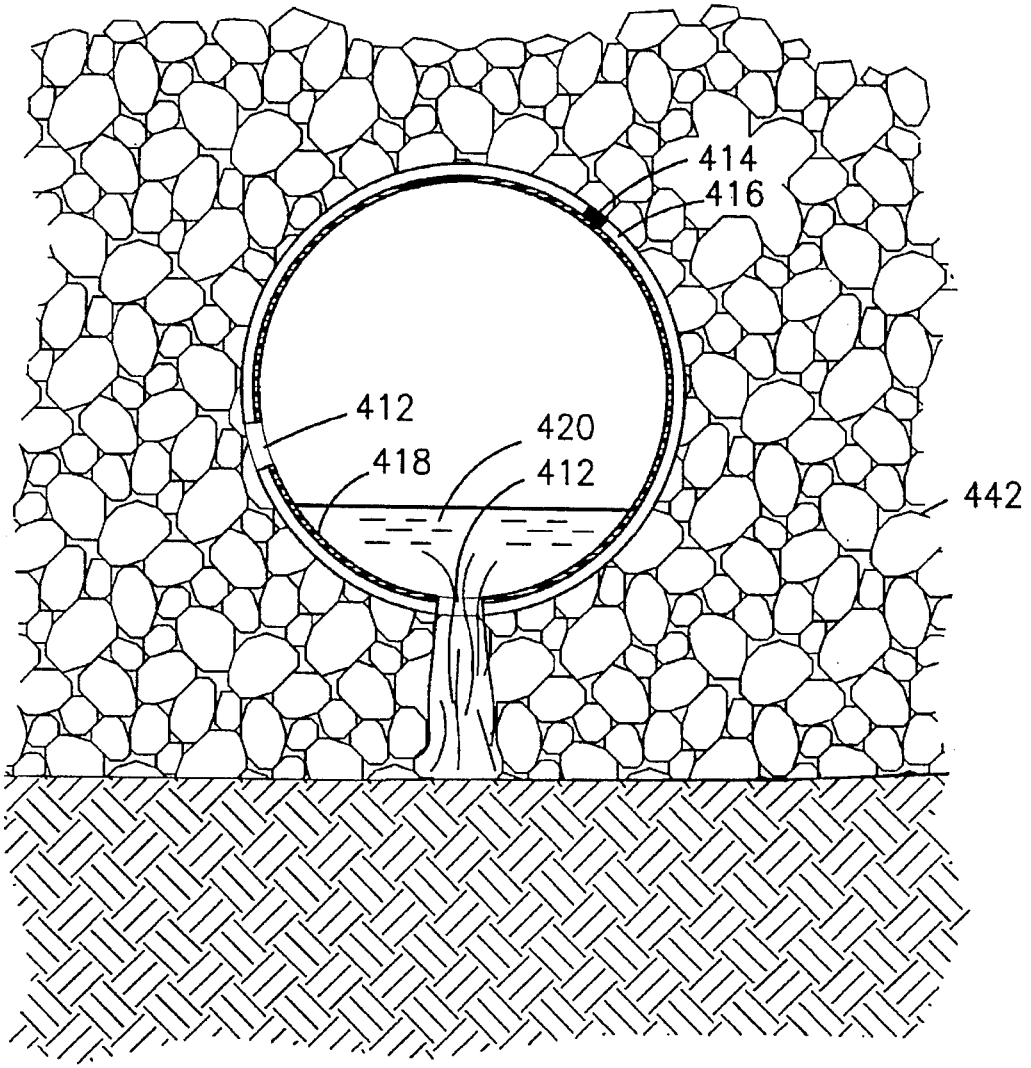
FIG. 11 is a partial cross-sectional view of the pipe of FIG. 10 illustrating twisting of typical pipe used within aggregate for a typical drainfield.

For a fuller appreciation of the needs in the industry, and with reference to FIG. 10, consider a drainfield pipe section 400 well known for use in the installation of on-site sewage treatment systems. Such pipe section 400 includes corrugations 410 and is well known to be highly flexible and difficult to align. Holes 412 as earlier described are positioned for draining effluent while maintaining portions of the effluent within the pipe section below the holes. To aid in the installation of pipe sections 400, a stripe 414 is often painted along a pipe section top surface portion 416 wherein the stripe 414 opposes that inside pipe portion 418 where secondary effluent treatment must take place. As illustrated in FIG. 11, if the pipe section 400 twists during installation, as if typically often does, as witnessed by the need to add a stripe for inspection of hole 412 positioning, effluent 420 intended to be held within the lower inside pipe portion 418, will drain directly into the absorption bed 422 thus avoiding desired secondary treatment.

Figure 12:
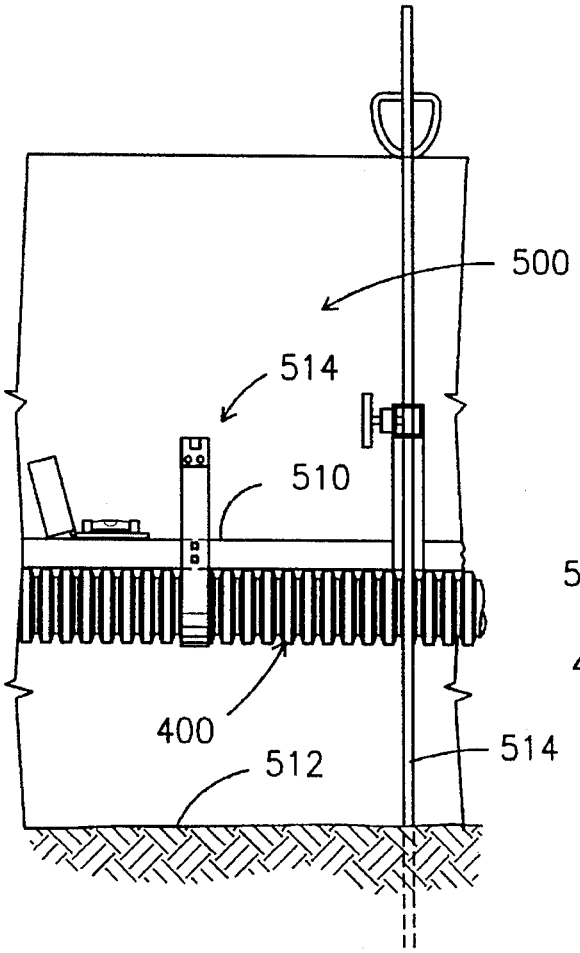
Fig. 12 PRIOR ART
FIG. 12 and FIG. 13 are partial side and front elevation views respectively of a prior art apparatus illustrating operation of the apparatus for positioning a drainfield pipe within a aggregate absorption bed.
Figure 13:
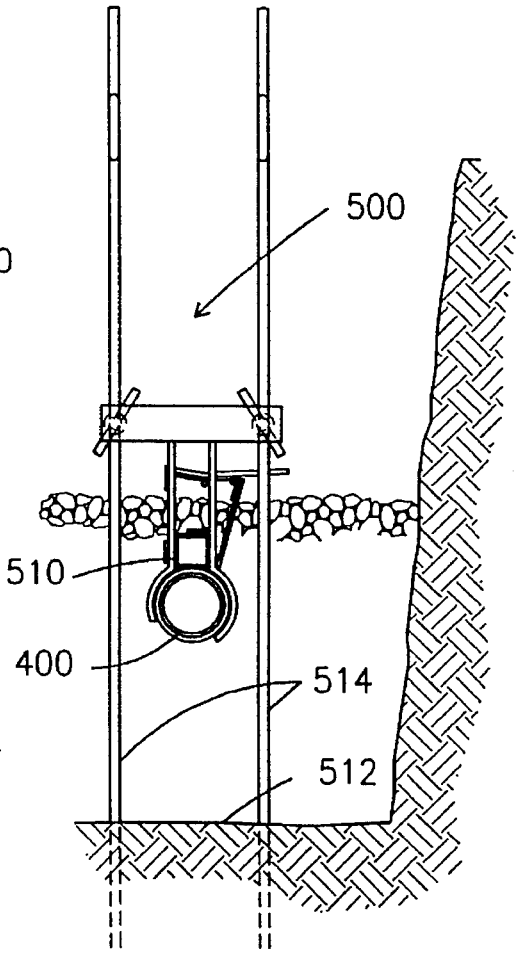
Fig. 13 PRIOR ART
Figure 14:
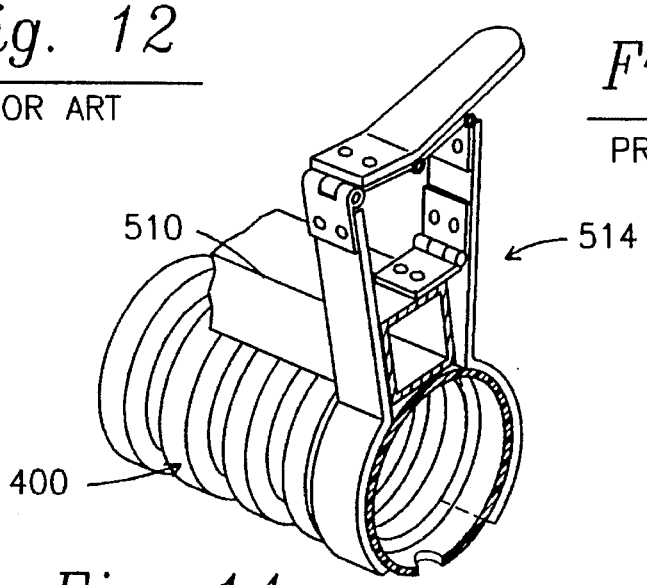
Fig. 14 PRIOR ART
FIG. 14 is a partial perspective view of a clamp of FIGS. 12 and 13 removably affixed to the drainfield pipe.

As described earlier within the background section of this specification, various devices have been developed in an attempt to satisfies the needs associated with the typically difficult installation. A clamping apparatus 500 as described with reference to FIGS. 12 through 14 provides a horizontal frame member 510 supported above grade surface 512 using elongated anchor members 514. Clamps 514 are affixed at spaced positions along the horizontal frame member 510, which clamps 514 generally surround the pipe section 400 as illustrated with reference to FIG. 14. In the arrangement illustrated, if the pipe section stripe 414 were included for the pipe section 400 to be laid, it would be obscured from view by the horizontal member 510. Twisting as earlier described would go unnoticed until the apparatus 500 was removed thus extending installation time. Further, it is desirable to have independent support devices 100 as in the present invention to have freedom to remove a single device 100 during the pouring of aggregate for partial lengths of pipe sections 200.

Figure 16:
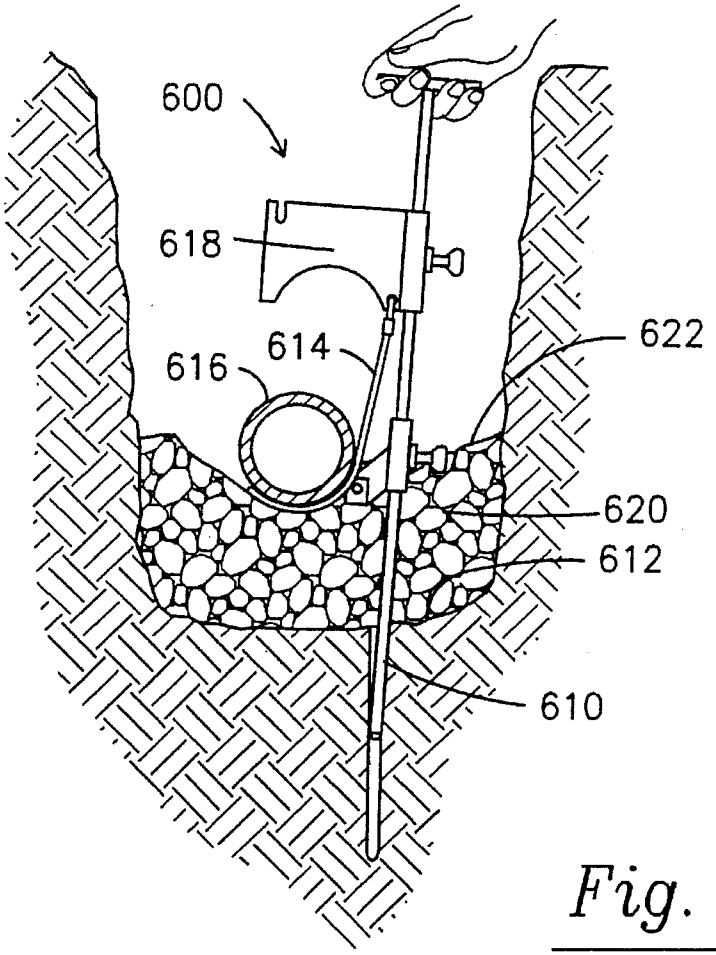
Fig. 16 PRIOR ART
FIG. 15 and FIG. 16 are partial cross-section views of a prior art device in operation for holding a pipe section within a trench for placing aggregate within the trench.
Figure 15:
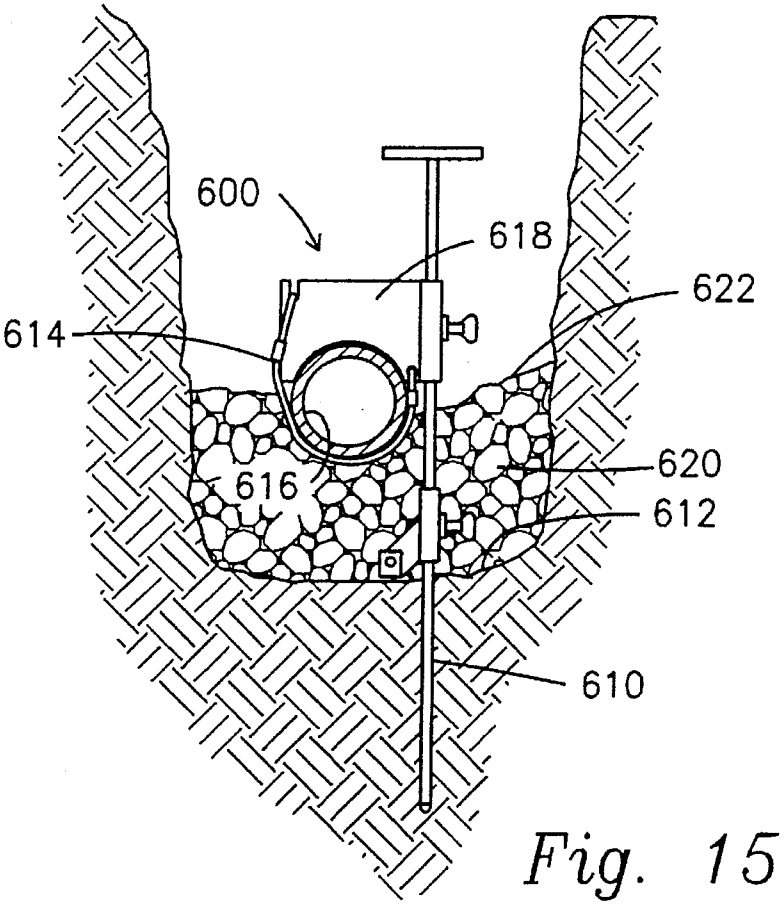
Fig. 15 PRIOR ART

As described in the background section, pipe support devices 600 have been developed as illustrated with reference to FIGS. 15 and 16, where individual anchor members 610 penetrate the grade surface 612. A cable 614 surrounds the pipe 616 while holding it against a cradle member 618 until aggregate 620 is poured to a desired level 622 prior to removing the devices 600 for finishing the pour. Although effective for typically rigid pipe 616 such as steel or PVC, when pulling the device 600 out of its position, the cable 614 surrounding the pipe 616 dislodges the highly lightweight and flexible drainfield pipe section 400 typically used for on-site sewage treatment systems.

Figure 17:
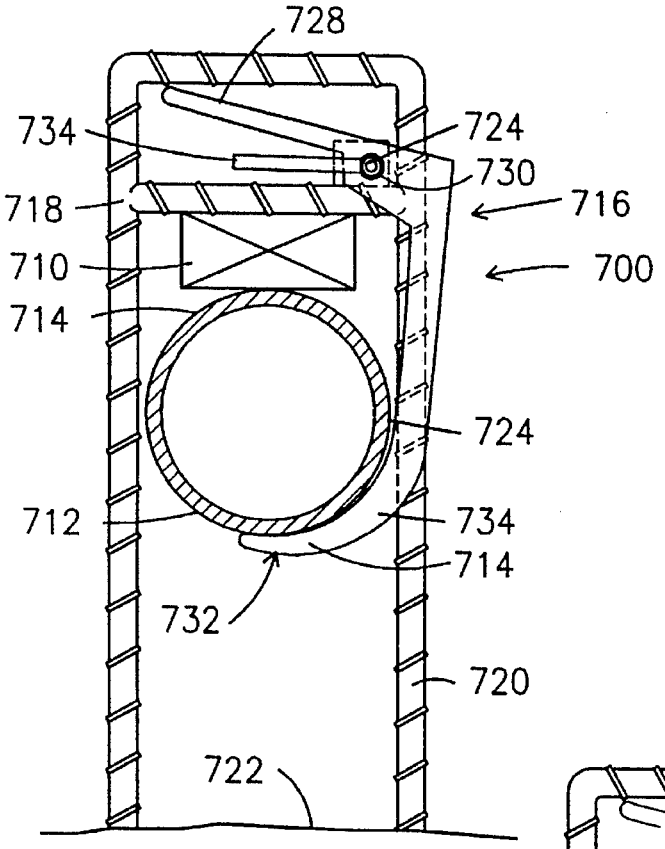
FIG. 17 is a front elevation view of a pipe holding device.
Figure 18:
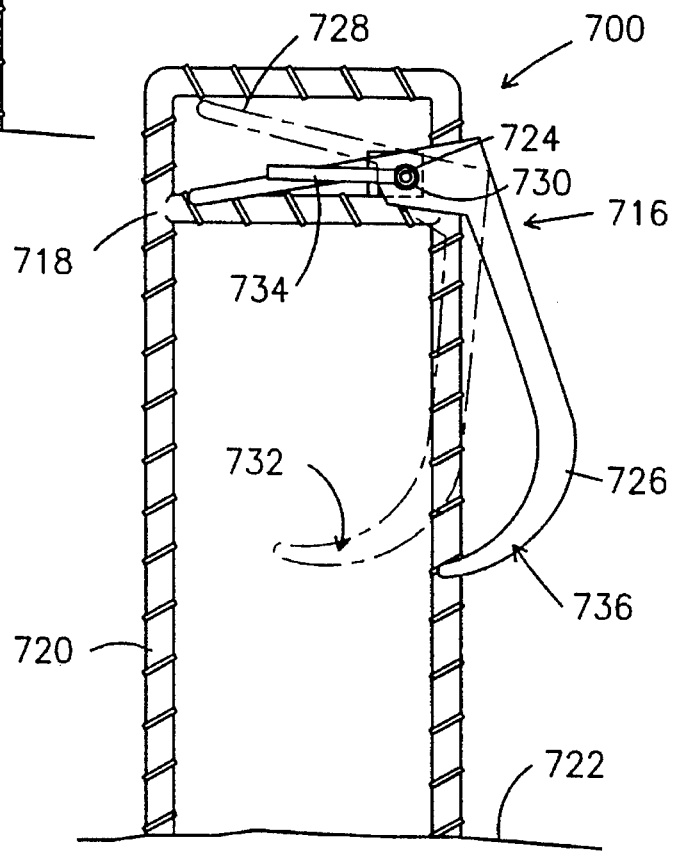
FIG. 18 is a partial elevation view of the embodiment of FIG. 17 illustrating a clamp in closed and open positions.
Figure 19:
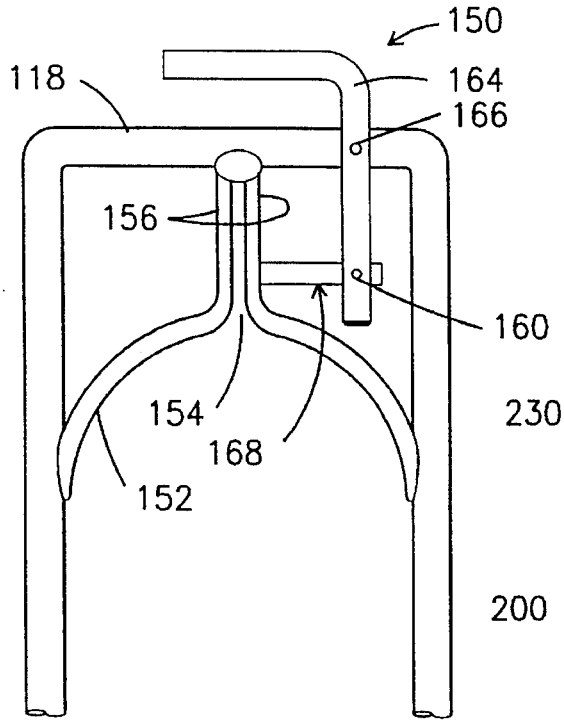
FIG. 19 is a partial front elevation view of an alternate embodiment of a supporting device of the present invention.
Figure 20:
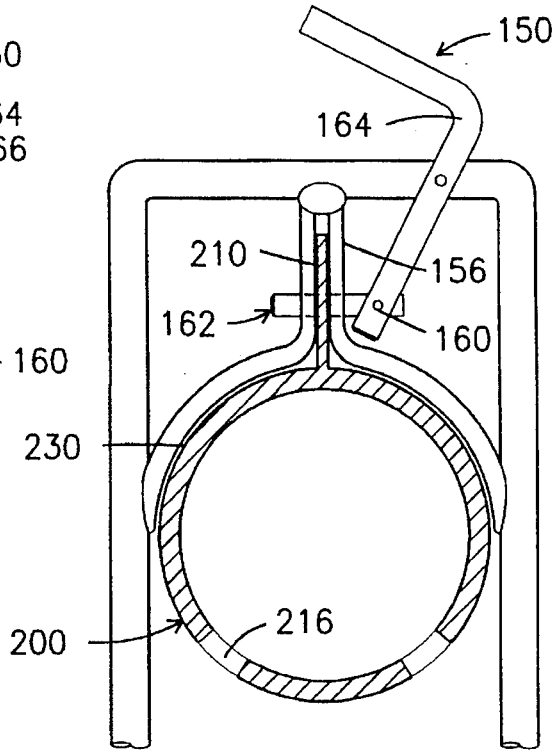
FIG. 20 is a partial front view of the embodiment of FIG. 19 illustrating the device clamping a rib of a pipe section.

During the development of the present invention, individual support devices 700 such as described with reference to FIGS. 17 and 18 were used and incorporated an elongated wooden plank 710 for supporting the pipe section 712. The plank 710, typically a 2×4, is held on a pipe section top surface 714 by a clamp 716 rotatably attached to an anchor top portion 718. The device 700 comprises elongated anchor members 720 for penetrating the grade surface 722 as earlier described for positioning the pipe section 712 at a desired elevation and position within the absorption bed. In one embodiment of the device 700 herein described, the clamp 714 partially surrounded one pipe section side 724 when in a closed position 724 as illustrated with reference to FIG. 18. The clamp 716 pivots about a pivot pin 724 positioned between a clamp distal end 726 and a clamp handle end 728. In the embodiment illustrated, the pivot pin 724 communicates with a lock nut 730 for frictionally holding the clamp 714 in its closed position 732. A wrench handle 734 attached to the nut 730 permits adjustment for tightening for the closed position 734 and loosening for an open clamp position 736 needed for removing the device 700.

Alternate embodiments of the devices 100 and pipe sections 200 are described with reference to FIGS. 19 through 26. In a first alternate embodiment 150 of the support device, as illustrated with reference to FIGS. 19 and 20, the pipe section tip surface portion 230 is held within a cradle member 152. A slot 154 is formed by tab members 156 extending from the device handle 118. The rib 210 slides within the slot 154 sufficiently deep to have the pipe section top portion 230 rest against the cradle member 152 as illustrated with reference to FIG. 20. A pin 158 is rotatably attached to a clamp handle distal end 160. The pin 158 is positioned to move into the slot 154 in a pin closed position 162 wherein it extends into the rib 210 for holding the pipe section 200 as illustrated with reference to FIG. 20. Once aggregate has been poured to its desired level, the pin 158 is pulled out of communication with the rib 210 by rotating a clamp handle 164 on a clamp proximal end 166 separated by the clamp distal end 160 by a second pivot pin 166 positioned for providing such movement. In an opened pin position 168, the rib 210 is out of communication with the pin 158 thus permitting the device 150 to be pulled away as earlier described with reference to the preferred embodiment.

Figure 21:
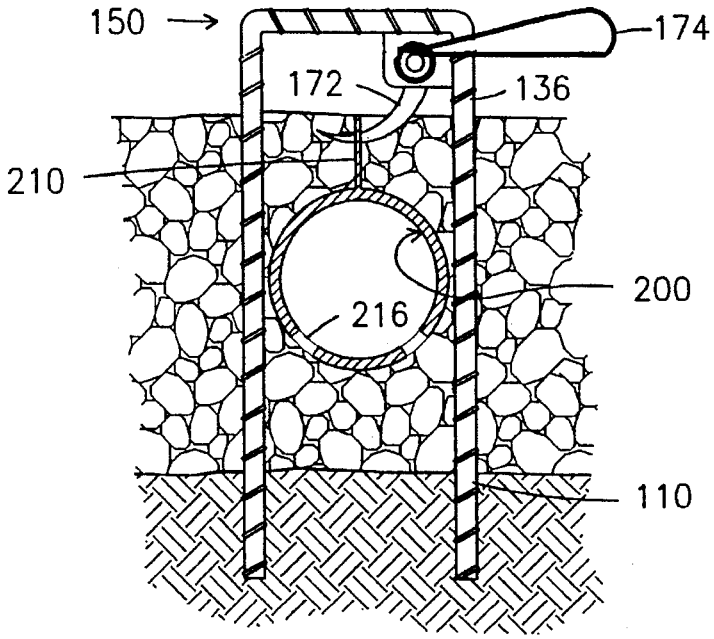
FIG. 21 is a front elevation view of an alternate embodiment of the present invention.

In yet another embodiment 170, as illustrated with reference to FIG. 21, the rib 210 is held by a hook 172 penetrating the rib 210 at one end and pivotally attached to the anchor member upper portion 136. As described with reference to FIGS. 17 and 18, a nut and wrench handle assemble 174 is used to lock the hook 172 in a closed position in communication with the rib 210 and loosen the hook 172 for pivoting out of communication with the rib 210 for pulling the device 150 away from the aggregate 232. The devices 150, 170 are used in the preferred method for installing the drainfield as described with reference to the preferred embodiment device 100.

Figure 22:
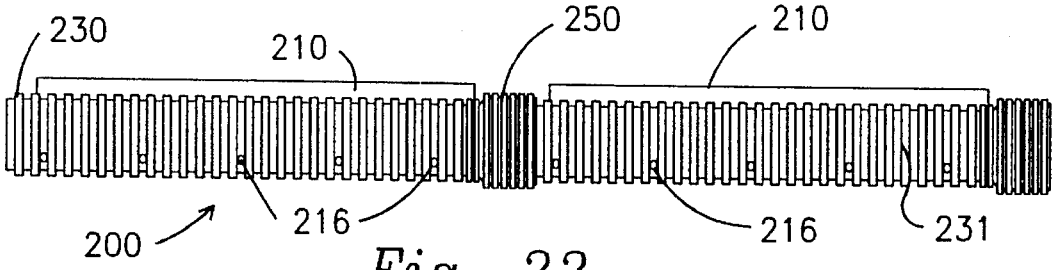
FIG. 22 is a side elevation view of interconnected pipe sections of an alternate embodiment of FIG. 3.
Figure 23:
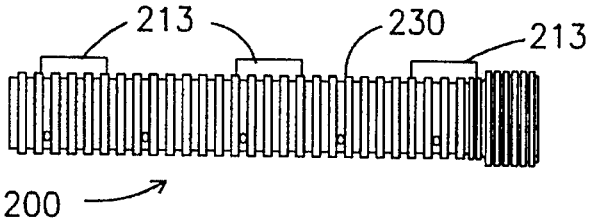
FIG. 23 is a side elevation view of yet another embodiment of FIG. 3.
Figure 24:
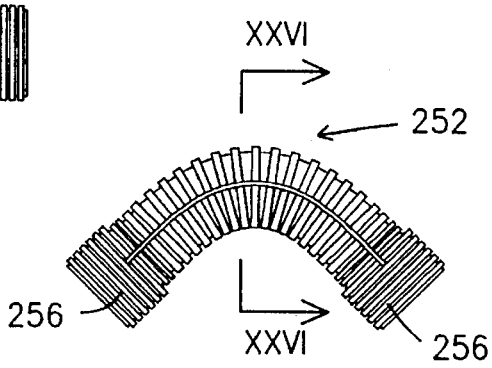
FIG. 24 is a top plan view of an alternate embodiment of the pipe section of the present invention illustrating a female to female connection elbow pipe section.
Figure 25:
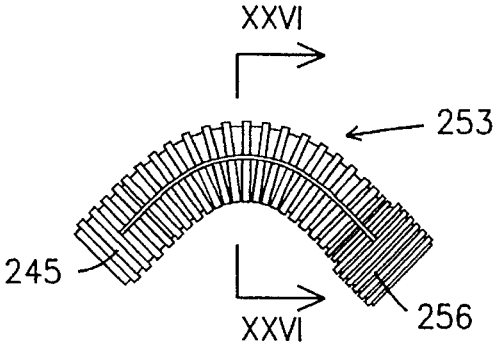
FIG. 25 is a top plan view of an alternate embodiment of FIG. 24 illustrating a male to female connection elbow pipe section.
Figure 26:
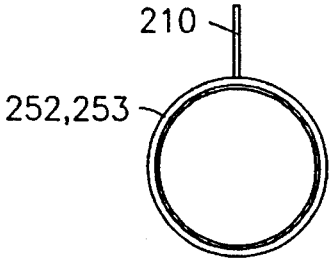
FIG. 26 is a cross-section view through the XXVI–XXVI plan of FIG. 24.

Alternate embodiments of pipe sections 200 are described with reference to FIGS. 22 through 26. With reference to FIG. 22, the rib 210 is extended along the pipe section top surface 230 including corrugated pipe section portions 246 as well as onto a female end connection portion 248 thus permitting a junction or interconnect location 250 to be directly supported by the device 100. Further, as illustrated with reference to FIG. 23, the rib 210 comprises rib sections 213 in spaced relation along the pipe section top surface 230. Such a configuration is useful when elevation changes require flexing of the pipe section 200 within the vertical plane. In addition to pipe sections 200 as earlier described, pipe section joint or elbow connections 252, 253 are used in certain installations. As illustrated, elbows 252, 253 will have male 254 and female 256 end connections as demanded by the pipe section 200 or the installation desired. In either case, the rib 210 is affixed as earlier described and as illustrated with reference to FIG. 26.

Figure 27:
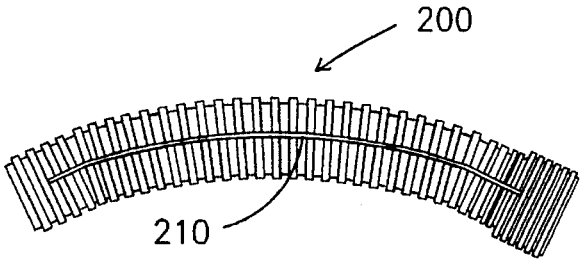
FIG. 27 is a top plan view of a pipe section of the present invention bending in a plane perpendicular to a plane passing through a radially extending rib of the pipe section of the present invention.

As earlier described, the rib 210 provides sufficient rigidity to the corrugated pipe section 200 for maintaining desired elevation and grade along the pipe section 200 during the pouring of aggregate 232. The pipe section 200 does have a flexibility in a horizontal plane generally perpendicular to the vertical plane 242 of the rib 200 which permits bending within the horizontal plane as illustrated with reference to FIG. 27. As earlier described with reference to FIG. 5, placing devices 100 every few feet along the pipe section 200 controls the bending for holding the pipe section 200 within the desired location as described with reference to FIGS. 7 and 8 for the system 300 installation. In such an installation, a separation 340 between pipe sections of drain field 316 as well as a separation 342 from absorption bed side walls 344 is desired.

While specific embodiments of the invention have been described in detail herein above, it is to be understood that various modifications may be made from the specific details described herein without departing from the spirit and scope of the invention as set forth in the appended claims. Having now described the invention, the construction, the operation and use of preferred embodiments thereof, and the advantageous new and useful results obtained thereby, the new and useful constructions, methods of use and reasonable mechanical equivalents thereof obvious to those skilled in the art, are set forth in the appended claims.

What is claimed is:

1. A method for installing an on-site sewage treatment drainfield comprising the steps of:

positioning a first set of pipe supporting devices, each device having means for removably clamping to a pipe upper portion for holding the pipe in suspended relation above an absorption area grade surface, the absorption area to be filled with an aggregate, each device further having anchoring means for anchoring the devices to the grade surface in a desired alignment for positioning pipe generally horizontally across the absorption area;

providing a first pipe section, each pipe section having perforations spaced longitudinally along the pipe section, the perforations spaced along a periphery of the pipe section, the pipe section further having a radially extending member extending from an upper portion therefrom, the upper portion opposing the effluent holding portion, the member dimensioned to be received by the clamping means;

clamping each device to the pipe member for supporting the first pipe section by the pipe supporting devices, the devices positioned in spaced relation to each other, the pipe section held at upper pipe portions displaced along the pipe section, the upper portion within an upper semicircular pipe portion in cross-section;

adjusting the supporting device for positioning the first pipe at a desired height above the grade surface;

positioning a second set of pipe supporting devices adjacent the first pipe, the second device set positioning substantially the same as the first device set positioning;

interconnecting first and second pipe sections;

clamping the second pipe member for supporting the second pipe section by the second set of pipe supporting devices in substantially the same manner as supporting the first pipe section;

positioning additional pipe sections for interconnecting with adjacent pipe for forming a drainfield system having pipe sections in fluid communication with each other;

pouring aggregate to a desired level for providing an absorption bed in fluid communication with the drain field pipe sections, the devices maintaining the pipe sections at a desired horizontal and vertical position within the absorption area;

releasing the pipe members from the clamping means thereby placing each pipe section out of communication with the devices; and removing the devices from their position by pulling each device generally upward out of anchoring engagement with the grade surface for providing a drainfield in fluid communication with an absorption bed of aggregate surrounding the pipe system of the drainfield.

2. The method as recited in claim 1, wherein each positioning step comprises the steps of driving vertically disposed elongate anchoring members into the grade surface.

3. The method as recited in claim 1, wherein the adjusting step comprises the steps of sensing a height above the grade surface for a portion of the pipe, vertically repositioning the device to the desired height above the grade surface, and repeating the height sensing and repositioning steps for each of the devices.

4. The method as recited in claim 1, wherein each pipe extending member comprises a rib extending radially outward from a top surface of the pipe section, the rib generally extending substantially along the length of the pipe section, the rib stiffening the flexible pipe in a plane passing through the rib and a central axis of the pipe section.

5. The method as recited in claim 4, wherein the clamping step comprises the step of biasing jaws of the claiming means against the rib member for holding each pipe section in a suspended location above the grade surface.

6. The method as recited in claim 1, wherein the pipe section perforations comprise holes spaced longitudinally along the pipe section and equally spaced on centers about the periphery wherein the perforations are above a low portion of the pipe section for holding effluent within the low portion, the pipe extending member generally opposing the low portion, the member clamping step further maintaining the pipe section for holding the effluent within the low portion.

7. The method as recited in claim 1, wherein the interconnecting step comprises the steps of:

positioning a pipe supporting device in substantially the same manner as the device sets;

providing a pipe fitting having a member extending radially therefrom;

supporting the fitting by clamping the device to the member; and interconnecting adjacent pipe sections to opposing ends of the fitting.

8. The method as recited in claim 1, further comprising the steps of:

aligning the first pipe section for interconnecting through a connecting pipe section to a septic tank outlet port;

positioning the first device set at a height above grade surface sufficient for receiving effluent passing out of the septic tank outlet port; and anchoring devices for other sets opposing the septic tank at varying heights above the grade surface, each device suspending a pipe portion at a lesser height that its adjacent device wherein the adjacent device is closer to the septic tank for providing a drainfield fall gradually away from the septic tank.

9. The method as recited in claim 1, wherein the pouring step comprises pouring aggregate to a first level proximate a top portion of each pipe section for substantially covering the pipe sections with the aggregate and a second pouring step bringing the surface level of the aggregate to a level substantially at an end portion of the pipe extending member, the second pouring step following the device removing step, the second pouring step bringing the aggregate to a grade level for receiving sand and sod.

10. A method for installing an on-site sewage treatment system comprising the steps of:

positioning a septic tank for providing effluent into a drainfield in fluid communication with the tank, the effluent passing through an outlet port of the tank;

positioning a first set of pipe supporting devices having means for anchoring the device into a grade surface of an absorption area, the supporting devices further having means for clamping a top portion of a pipe section and in combination with the anchoring means holding the pipe section at a desired height above a grade surface of the absorption area;

supporting a header pipe section by clamping the device to a rib extending radially from the header pipe section, the rib extending along a perimeter portion of the pipe section, the header pipe section having a connection port for fluid communication with the tank and a plurality of connection ports for interconnecting drainfield perforated pipe sections thereto;

vertically adjusting the support devices communicating with the header pipe by moving vertically disposed anchoring means members through the grade surface for positioning the header pipe at a desired height relative to the tank outlet port;

interconnecting the header pipe section to the tank outlet port;

interconnecting first end portions of perforated drainfield pipe sections to the header pipe section ports, each perforated pipe section having holes located longitudinally along the pipe section for providing fluid communication with aggregate surrounding the pipe sections, the holes formed above a low pipe portion thereby permitting effluent to be held within the low portion, each pipe section further having a rib extending radially from the pipe section outer wall, the rib extending longitudinally along a perimeter portion of the pipe section, the rib generally opposing the low portion;

positioning additional sets of pipe supporting devices in the same manner as the earlier positioning for holding the pipe section at a desired height above a grade surface of the absorption area;

removably clamping each device set to each pipe upper portion in the same manner as the header pipe section for holding each pipe section in suspended relation above the absorption area grade surface;

vertically adjusting each support devices communicating with each pipe section by moving the vertically disposed anchoring means members through the grade surface for positioning portions of each pipe section at a desired height relative to the tank outlet port;

distributing aggregate to a desired level for providing an absorption bed in fluid communication with the drain field pipe sections, the devices maintaining the header and perforated pipe sections within a desired horizontal and vertical position;

releasing the pipe members from the clamping means thereby placing each pipe section out of communication with the devices; and removing the devices from their position by pulling each device generally upward out of anchoring engagement with the grade surface for providing a drainfield in fluid communication with the septic tank and the absorption bed of aggregate surrounding the pipe sections.

11. The method as recited in claim 10, further comprising the steps of:

interconnecting first end portions of additional perforated drainfield pipe sections to second end portions of the perforated pipe sections, for providing fluid communication with the perforated pipe sections, the additional pipe sections also having perforations for providing fluid communication with additional aggregate surrounding the additional pipe sections;

further positioning the devices available from the removing step in a similar manner as the first perforated pipe was positioned;

removably clamping each device each pipe upper portion in the same manner as the first perforated pipe sections holding each additional pipe section in suspended relation above the absorption area grade surface;

vertically adjusting each support devices communicating with each pipe section in the same manner as the first pipe sections were adjusted for positioning portions of each pipe section at a desired height;

distributing additional aggregate to a desired level for providing an extended absorption bed in fluid communication with the drain field pipe sections, the devices maintaining the header and perforated pipe sections within a desired horizontal and vertical position; and removing the devices from their position in a manner as was done for the first pipe section by pulling each device generally upward out of anchoring engagement with the grade surface for providing an extended drainfield in fluid communication with the septic tank and an extended absorption bed of aggregate surrounding the pipe sections.

12. The method as recited in claim 10, further comprising the steps of interconnecting second end portions of the perforated drainfield pipe sections to second header pipe section ports for providing continuous fluid communication between pipe sections, the second header pipe section having a rib extending radially from the header section outer wall, the rib extending longitudinally along a perimeter portion of the header pipe section and positioning the second header pipe section in a manner as the positioning of the header pipe section, the second header pipe section interconnecting and positioning steps made prior to the aggregate pouring step.

13. The method as recited in claim 10, wherein the pipe sections further comprise corrugations, the corrugations providing pockets within the pipe walls for collecting effluent and holding it during secondary effluent treatment, the corrugations further providing flexibility to the pipe section, the rib stiffening the pipe section for limiting bending of the pipe section within a plane passing through the rib and longitudinal axis of the pipe section, the rib generally perpendicular to a plane generally containing a highest level of flexing.

14. The method as recited in claim 10, wherein the supporting device comprises:

an elongated anchoring member for vertically extending a distal end into the grade surface; and the clamping means comprising a handle having a first jaw member, the handle pivotally connected to a proximal end of the anchoring means, the proximal end further having a second jaw member positioned for receiving the pipe rib wherein the first and second jaw members bias against side walls of the rib for securing the pipe within the desired suspended position above the grade surface.

15. The method as recited in claim 14, wherein the releasing step comprises the step of rotating the clamp handle for disengaging biasing contact of the rib between the jaw members.

16. A device for supporting pipe sections in a desired position during construction of drain fields which includes connecting pipe sections and surrounding the sections with an aggregate, the device comprising:

an elongated anchoring member, the anchoring member having a distal end for penetrating into a grade surface for supporting the anchoring member in a generally vertical position; and means for clamping a top portion of a pipe section for holding the pipe section in a desired position above the grade surface, the clamping means affixed to a proximal end of the anchoring member.

17. The device as recited in claim 16, wherein the clamping means comprises:

a handle pivotally connected to a portion of the anchoring member proximal end;

a first jaw member affixed to a portion of the handle for movement during handle pivoting; and a second jaw member affixed to the anchoring proximal end for communicating with the first jaw member for holding a pipe section rib extending radially outward from the pipe section wall, the rib biased between the jaw members for holding the pipe section in the suspended position above the grade surface.

18. The device as recited in claim 16, wherein the clamping means comprises:

a handle pivotally connected to a portion of the anchoring member proximal end;

tab members extending generally vertically downward from the anchoring member proximal end, the tab members forming a slot dimensioned for receiving a rib extending radially outward from a pipe section wall, the tab members having holes opposing each other for receiving a pin;

a pin pivotally connected to the handle, the pin dimensioned for passing through the tab member holes and through the pipe section rib, the pin removed from the slot for permitting the rib to pass into the slot in a pin first position, and the pin passing through the tab member holes and through a portion of the rib for holding the pipe section in the suspended position above the grade surface in a pin second position.

19. The device as recited in claim 16, wherein the clamping means comprises:

a handle pivotally connected to a portion of the anchoring member proximal end; and a hooking member affixed to the handle in pivoting communication with the handle for rotating from a first position out of contact with a pipe section rib extending radially outward from the pipe section wall to a second position wherein the hooking member penetrates a rib portion for clamping the pipe in a position suspended above the grade surface.

20. The device as recited in claim 16, wherein the clamping means further comprises means for receiving a rib extending radially outward from a pipe section side wall, the rib sufficient for stiffening the pipe section for movement within a plane containing the rib and a longitudinal axis of the pipe section, the rib extending substantially longitudinally along the pipe section wall, the rib further positioned opposite a portion of the pipe section for holding effluent when the pipe in an operating position generally horizontal within a drainfield pipe system.

* * * * *